United States Patent [19]

Peterson

[11] 4,199,918

[45] Apr. 29, 1980

[54] CUP LOADER MACHINE

[75] Inventor: Bertel R. Peterson, San Juan Capistrano, Calif.

[73] Assignee: FBM International, Inc., Minneapolis, Minn.

[21] Appl. No.: 871,362

[22] Filed: Jan. 23, 1978

[51] Int. Cl.[2] ..... B65B 5/08; B65B 35/44

[52] U.S. Cl. ..... 53/537; 53/247; 53/251; 53/543; 294/87.26; 414/730

[58] Field of Search ..... 53/247, 249, 250, 251, 53/496, 531, 537, 543; 214/1 BB; 294/87.26

[56] References Cited

U.S. PATENT DOCUMENTS

| | | | |
|---|---|---|---|
| 2,898,716 | 8/1959 | Cella et al. | 53/247 X |
| 2,899,233 | 8/1959 | Cella et al. | 214/1 BB |
| 2,904,944 | 9/1959 | Notredame et al. | 53/247 X |
| 2,957,287 | 10/1960 | Cella | 53/250 X |
| 3,826,382 | 7/1974 | Zappia | 414/730 |

FOREIGN PATENT DOCUMENTS

| | | | |
|---|---|---|---|
| 2323693 | 11/1974 | Fed. Rep. of Germany | 53/247 |
| 707067 | 4/1954 | United Kingdom . | |
| 707876 | 4/1954 | United Kingdom . | |
| 713889 | 8/1954 | United Kingdom . | |
| 715134 | 9/1954 | United Kingdom . | |
| 749818 | 5/1956 | United Kingdom . | |
| 968485 | 9/1964 | United Kingdom . | |
| 1080408 | 8/1967 | United Kingdom . | |
| 1356872 | 6/1974 | United Kingdom . | |
| 1486783 | 9/1977 | United Kingdom . | |

*Primary Examiner*—Robert Louis Spruill
*Assistant Examiner*—J. Reed Batten, Jr.
*Attorney, Agent, or Firm*—Schroeder, Siegfried, Ryan, Vidas, Steffey & Arrett

[57] ABSTRACT

A carton filling machine for receiving a plurality of tapered wall containers from a serial conveyor and loading them into cartons. The containers are assembled in a collecting area within the machine and engaged by a clamp head assembly. The clamp head assembly is moved horizontally to a position above a case conveyor. Opened cases on the case conveyor are moved vertically into a container receiving position below the cup clamp assembly to receive containers therefrom.

9 Claims, 16 Drawing Figures

140
23
24
21
22
19
20
15
99
92
120
93
26
90
14
135
137
133
138
136
104
122
118
110
103
6
117
92,93
115
96
101
102
98
62
64
63
66
60
63'
67
65
62'
94
50

CUP LOADER MACHINE

This invention relates to a machine for loading a plurality of tapered wall containers into opened cases. More particularly it relates to a machine for assembling a plurality of tapered wall containers received on a serial conveyor and loading them into cases received from a case conveyor. It also relates to conveying apparatus for tapered wall containers.

There is a very substantial need for carton filling machines for loading tapered wall containers into cases. Tapered wall containers are often used in the dairy industry for packaging of yogurt, sour cream, or cottage cheese. The containers which are normally formed from wax or plastic-coated cardboard are often utilized in the dairy industry because a substantial number of fully formed cups can be stored, in a nested fashion, in a relatively small space compared to the amount of space which would be necessary to store a similar number of cylindrical walled and therefore nonnestable containers.

Some of the problems encountered with prior art container loading machines for conveying and loading tapered wall containers relate to the tendency of such containers to tip or jam as they are driven against each other. The containers which are normally filled with a heated fluid are also normally quite fragile during the case loading process. Finally, the containers, when filled with portions of hot yogurt and fruit jelly, are also sensitive to an undesired mixture of the two constituent substances if the contents of the containers are unnecessarily subjected to jarring movement.

Accordingly, it is a primary object of the present invention to provide an improved container assembling and loading machine for automatically packing containers into shipping cases.

Another object of the present invention is to provide an improved container packing machine for automatically receiving containers from a supply line and for assembling and loading them simultaneously into shipping cases.

These and other objects and advantages of the invention will more fully appear from the following description, made in connection with the accompanying drawings, wherein like reference characters refer to the same or similar parts throughout the several views, and in which.

Figure 11:
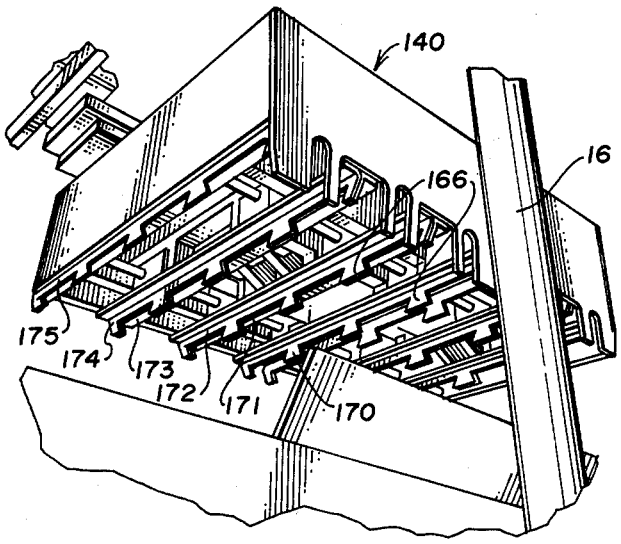
Figure 2:
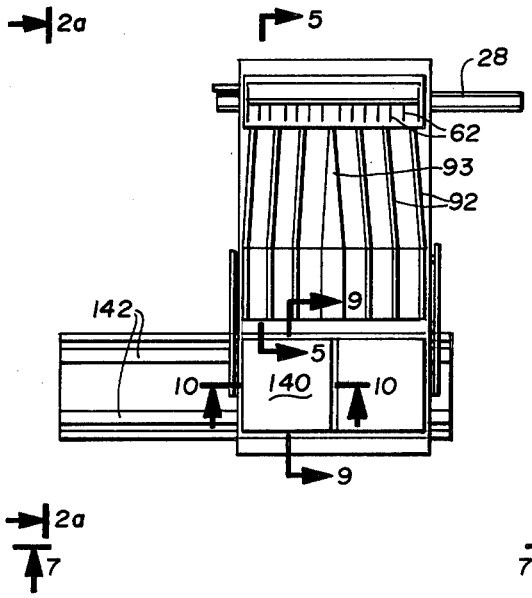
FIG. 2 is a simplified layout of the machine.
Figures 3, 4, 12:
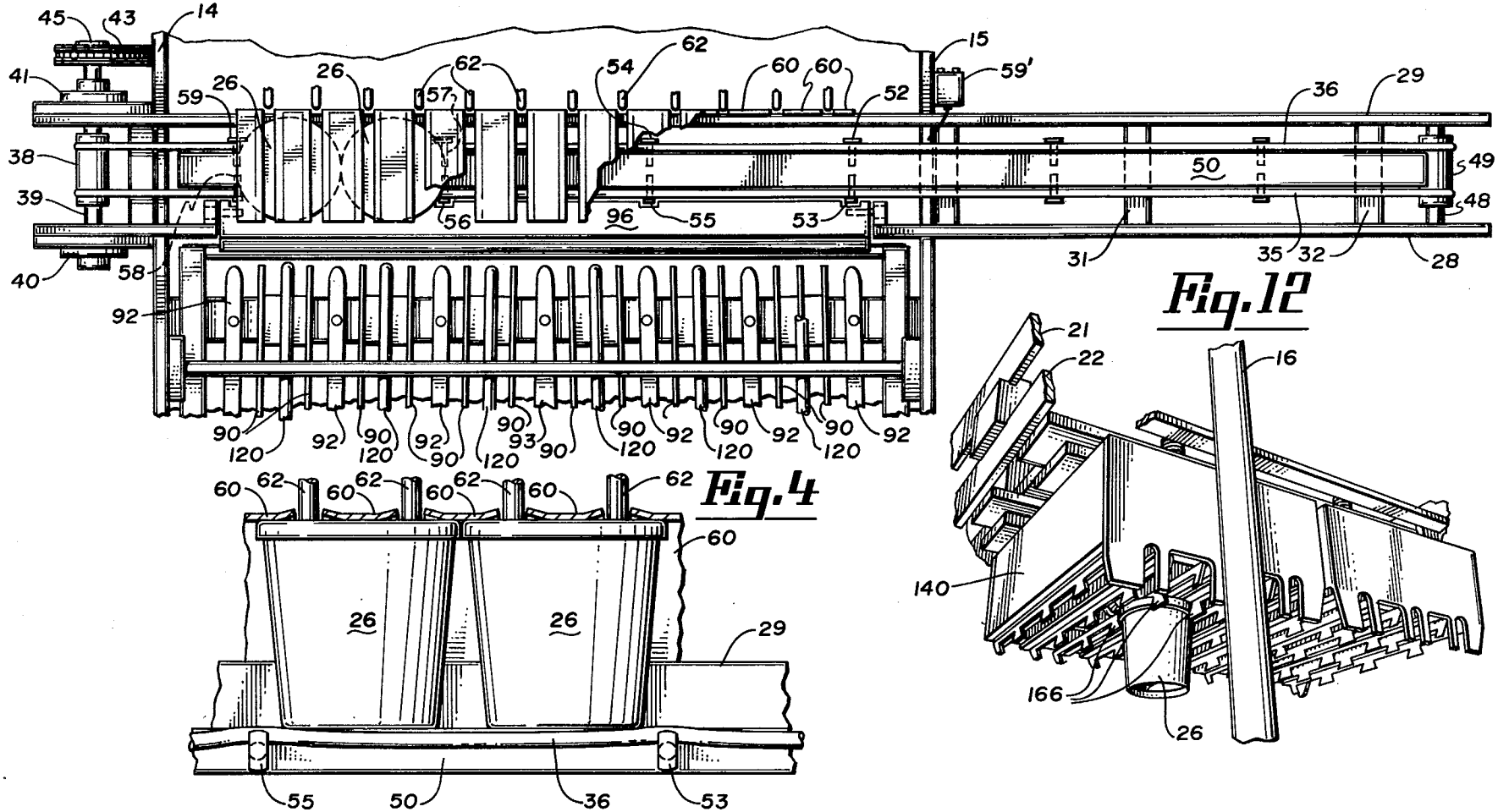
FIG. 3 is a top view showing the infeed conveyor.
FIG. 4 is a view showing two containers located on the infeed conveyor.
Figure 10:
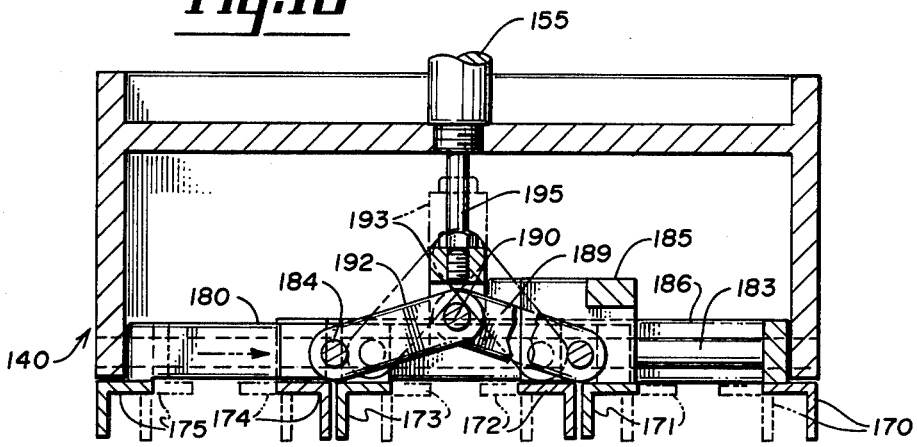
Figure 8:
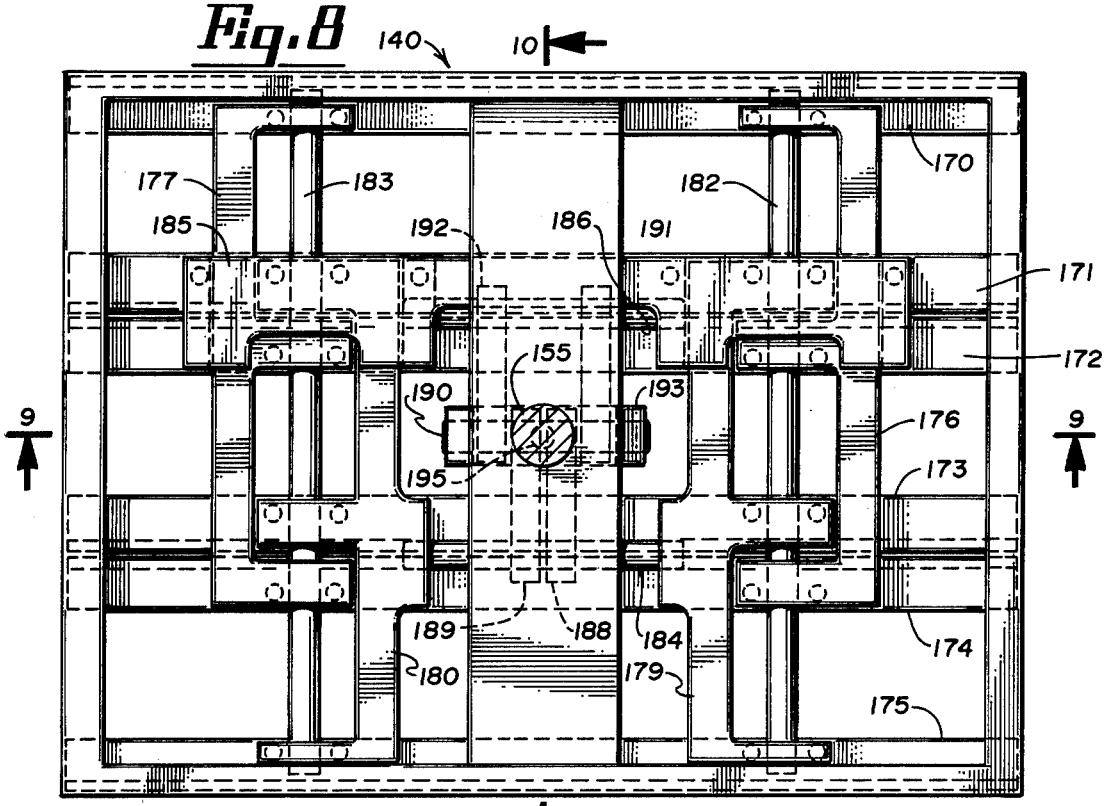
Figure 9:
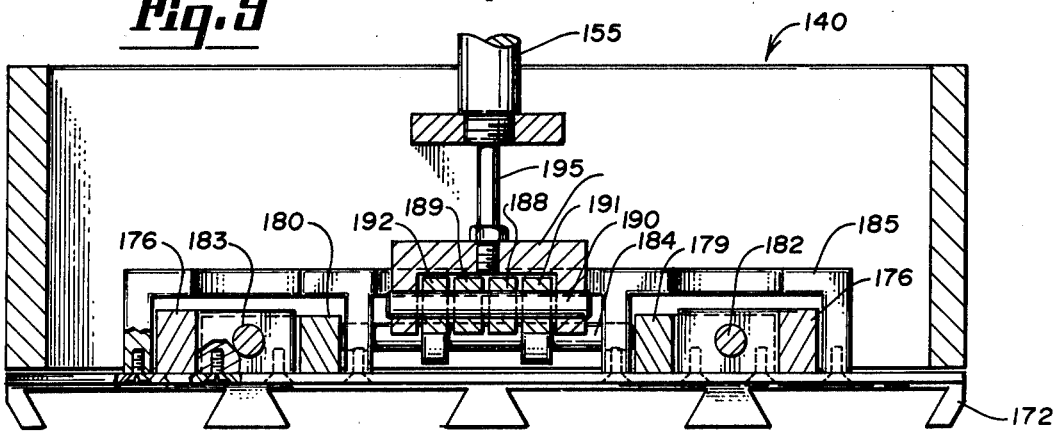
Figures 13, 13A:
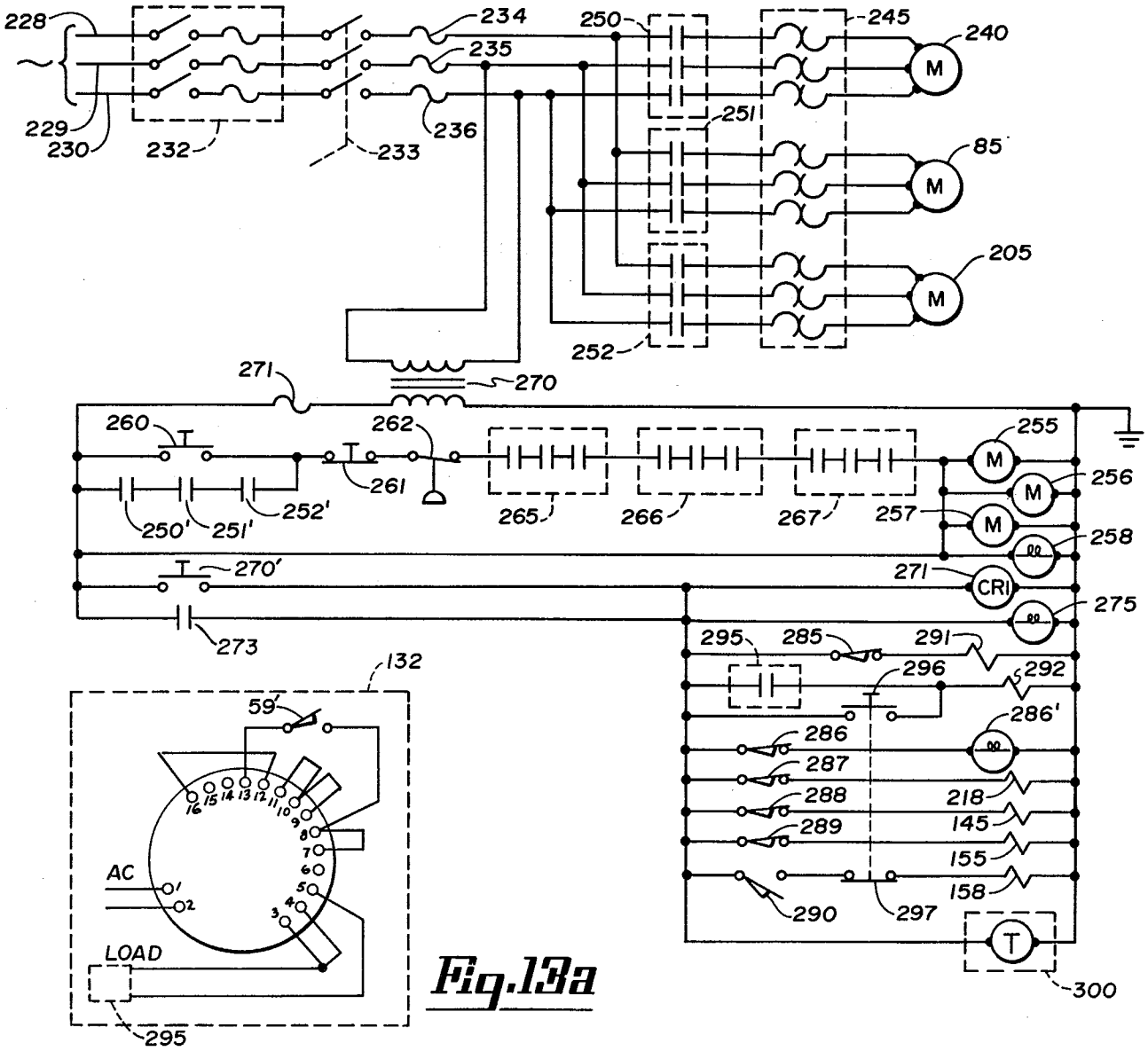
Figure 14:
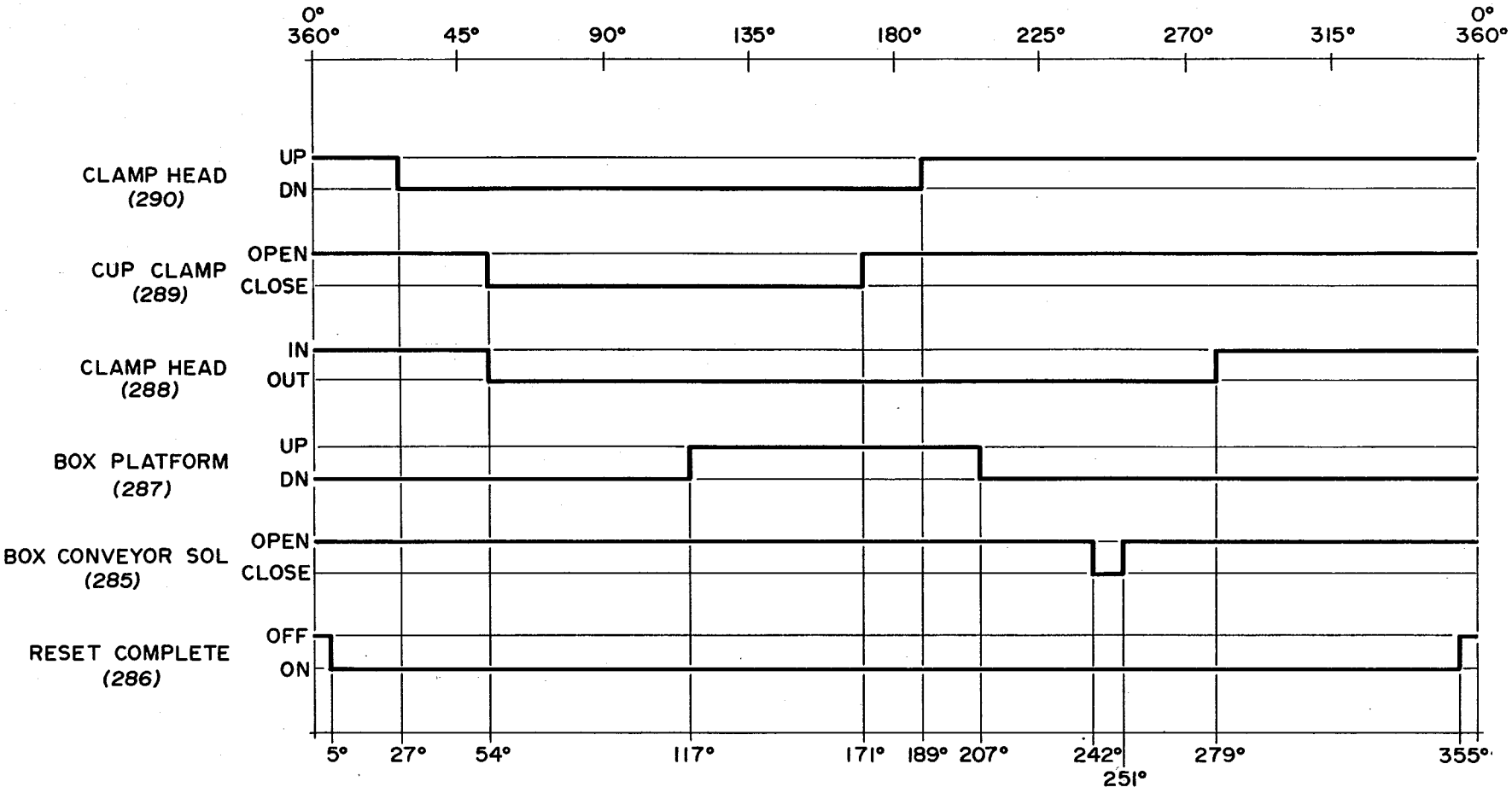

FIG. 8 is a top view of one of the two identical halves of the cup clamp head assembly, and FIGS. 9 and 10 are cross-sectional views thereof taken on lines 9—9 and 10—10 respectively of FIGS. 2 and 8;

FIGS. 11 and 12 are perspective views of the head assembly in the opened and closed positions respectively;

FIG. 13 is a schematic diagram of the electrical circuit, while FIG. 13*a* is the wiring diagram for the scale of six counter used to detect receipt of a complete row of containers from the infeed conveyor; and FIG. 14 is a chart showing the actuation of the various contacts of the control circuit relative to the operatings cycle.

Figure 1:
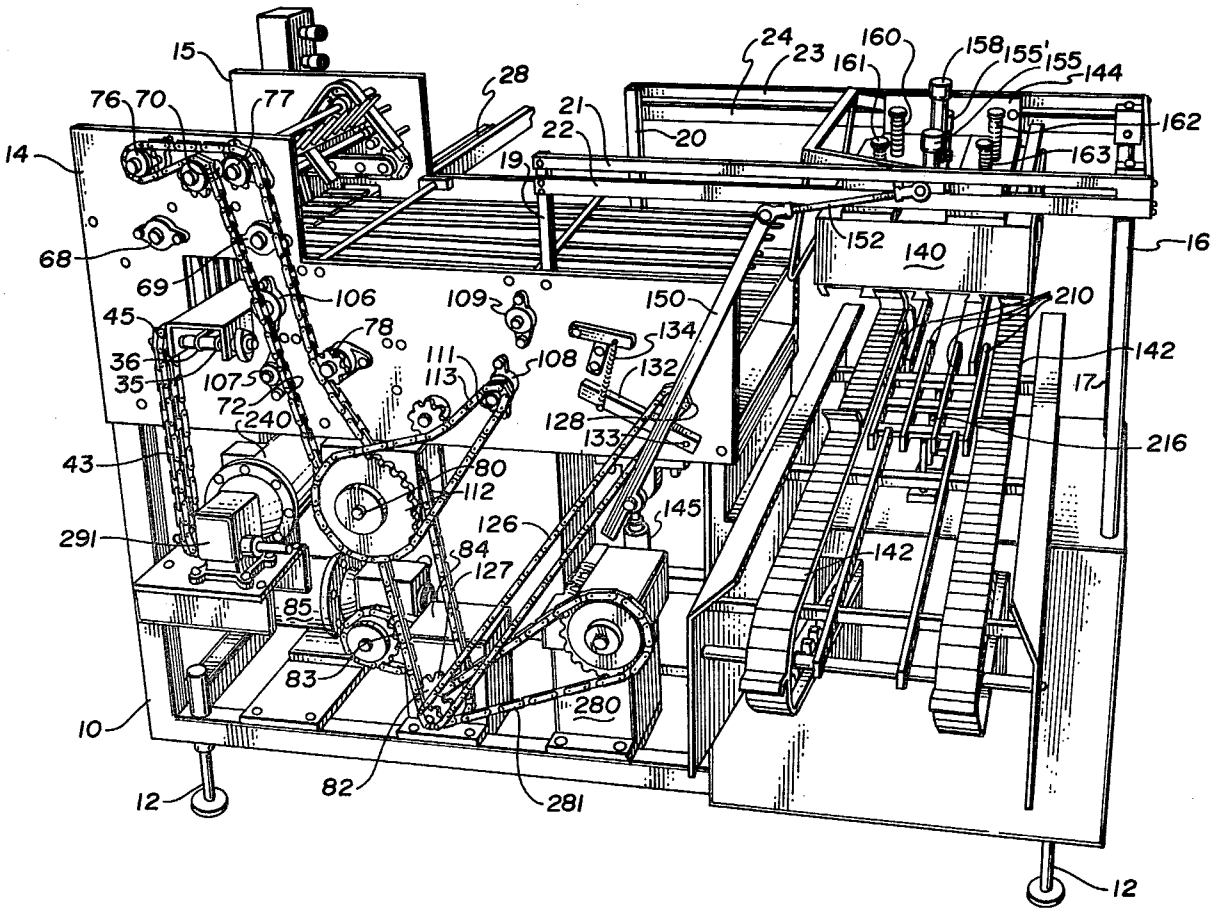
FIG. 1 is a perspective view of the entire machine.

Referring now to FIG. 1, a frame 10 is mounted on vertically adjustable legs 12 and carries a pair of side plates 14 and 15 at one end of the machine. Vertical supports 16 and 17 are mounted at the other end of the machine while further vertical supports 19 and 20 are mounted on side plates 14 and 15. Vertical supports 16, 17, 19, and 20 support horizontal members 21 and 22 at the front of the machine and 23 and 24 at the rear of the machine as viewed in FIGS. 1 and 2*a*.

Tapered wall cups or containers 26, as shown in FIG. 4, are conveyed into the lefthand side of the machine by the conveyor mechanism shown in FIG. 3. The cup infeed conveyor mechanism is comprised of a pair of frame members 28 and 29 which are separated by crossbars 31 and 32. Cups 26 are moved along the conveyor by a pair of O-ring belts 35 and 36 which are driven by a pulley 38 mounted on a shaft 39 which is rotatably journaled between frames 28 and 29 by suitable bearing assemblies 40 and 41. A chain 43 drives a sprocket 45 mounted on shaft 39. The other end of belts 35 and 36 pass over a pulley 49 mounted on a shaft 48 which is rotatably journaled between frames 28 and 29. Belts 35 and 36 are supported by a raceway 50 which is mounted on crossbars 31 and 32 and supports the portions of belts 35 and 36 outside of side plates 14 and 15 so that the belts are held in contact with the bottom portion of containers 26.

The portion of belts 35 and 36 between side plates 14 and 15 is not supported by the grooves in raceway 50. The flexible O-ring belts 35 and 36 are allowed to droop between progressive pins 52 through 59 which are placed at particular intervals along the conveyor path. The spacing of progressive pins 52–59, et seq., is at intervals approximately two times the maximum diameter of container 26. In addition to being separated by a specific distance determined by the diameter of tapered wall containers 26, progressive pins 52–59 are located at predetermined longitudinal positions relative to side plates 14 and 15 as described in more detail below.

The cup infeed conveyor shown in FIG. 3 serves to interface the carton filling machine with a serial conveyor to receive filled cups from conventional container filling machinery not shown. Individual containers 26 are received and conveyed on belts 35 and 36 into the area between side plates 14 and 15. The initial containers 26 which pass through side plate 15 to enter the machine make a positive frictional contact with belts 35 and 36 as they pass over pins 52 and 53. Although the unsupported portions of belts 35 and 36 provide no drive force to containers 26, the containers' momentum continues to move them along the conveyor past pins 52 and 53 to an intermediate stopping position between pins 52–53 and 54–55 until a third container 26 is driven by belts 35 and 36 past pins 52 and 53, striking the two containers between pins 52 and 53 and pins 54 and 55, and bringing the first of those containers into a positive frictional contact with the portion of belts 35 and 36 passing over pins 54 and 55, causing that container to move to a new intermediate stopping position between pins 55 and 56. As further containers 26 are received, they are progressed in a similar manner until a total of six containers are in predetermined longitudinal positions along the infeed conveyor between side plates 14 and 15 of the machine.

The use of progressive pins 52–59 to support flexible belts 35 and 36 to form a discontinuous drive conveyor serves to overcome one of the significant problems which would be encountered with prior art machines when attempts are made to use them to load tapered wall containers into areas. If the driven conveyor belts 35 and 36 were supported in positive frictional contact with the bottom surface of containers 26 after the containers reached their proper position at the end of the infeed conveyor, damage to the bottom of container 26 would be likely to occur due to the continuing frictional drive of the continuously moving conveyor elements. In the yogurt manufacturing industry in particular, wax-coated cups which are filled with hot liquid at the time of packing are particularly susceptible to damage. In the preferred embodiment shown, the conveyor belts 35 and 36 are not in continuous frictional engagement with the bottom surface of container 26 after the containers reach their intended position on the infeed conveyor.

As the cups enter the machine, they are restrained from tipping as they are moved along the infeed conveyor by a series of plates 60, shown in FIGS. 3, 4, and 5, which are separated to allow passage between them of elongated bars 62 and 62' which are driven, as described below, to move containers 26 from the infeed conveyor to a further position in the case loading machine where further conveying means engage them.

Figure 2A:
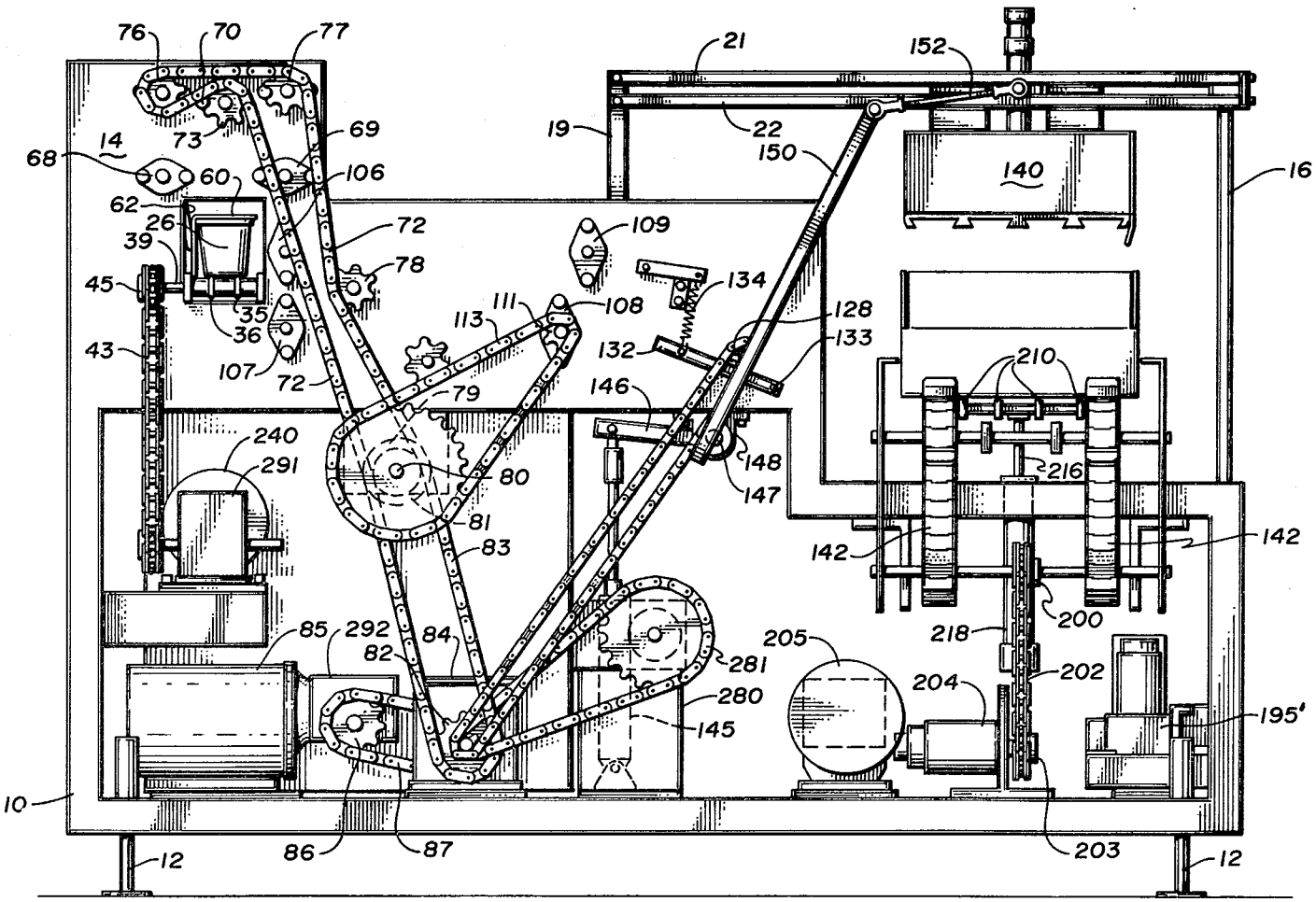
FIG. 2*a* is a side view of the machine taken on lines 2*a*—2*a* of FIG. 2.
Figures 5, 6:
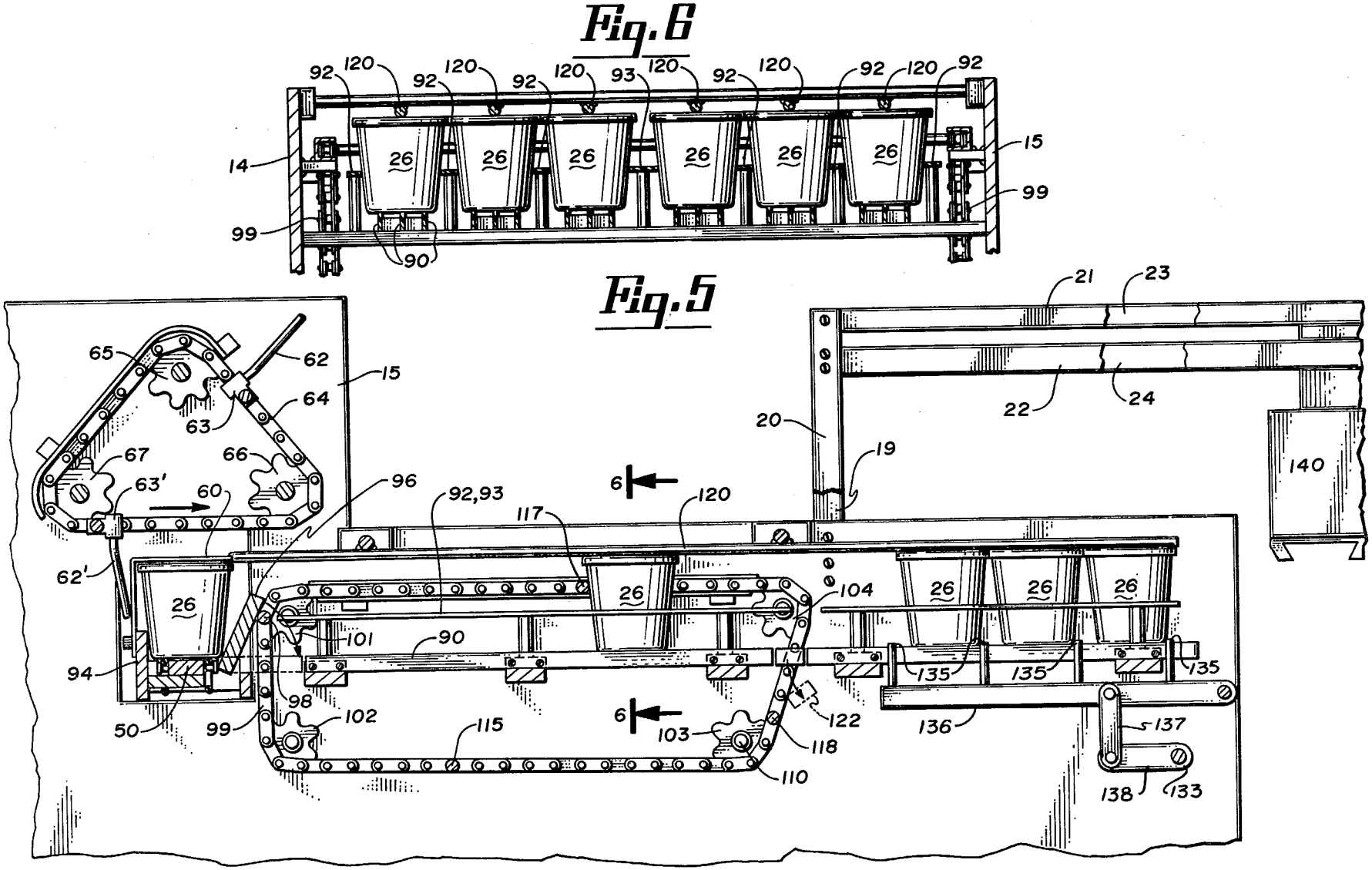
FIG. 5 is a cross section taken on lines 5—5 of FIG. 2 showing the movement of cups from the infeed conveyor through the machine.
FIG. 6 is a cross section taken on lines 6—6 of FIG. 5 showing a row of cups at a particular location within the machine.

The details of the mechanism for unloading containers 26 from the infeed conveyor are shown in FIG. 5. A series of bars 62 and 62' are mounted on supporting brackets 63 and 63' carried by a chain 64 which passes over sprockets 65, 66, and 67 which are journaled in bearings 68, 69, and 70, as shown in FIG. 2*a*. A similar chain arrangement, not shown, supports the other end of brackets 63 and 63'.

Sprocket 65 is driven by a chain 72 which drives a sprocket 73 mounted on the same shaft as sprocket 65. Chain 72 passes over idler sprockets 76, 77, and 78 which are journaled on side plate 14. Chain 72 is driven by a sprocket 79 mounted on a shaft 80 which is driven by a sprocket 81 also mounted thereon and which is connected to a sprocket 82 by a chain 83. Sprocket 82 is driven by a reducer 84 which is in turn driven by a motor 85 through a clutch 292. Clutch 292, when actuated by the circuitry shown in FIG. 13, couples the output of motor 85 to a sprocket 86 and a chain 87 which in turn drives a further sprocket not shown at the rear of reducer 84. Reducer 84 is anchored to frame 10.

The normal direction of rotation of sprocket 65 in FIG. 5 is counterclockwise. As that sprocket is rotated and chain 64 is driven, the group of bars 62 or 62' passes between plates 60, and each bar makes contact with both the cover and the sidewall of one of the containers 26, driving the containers from the infeed conveyor onto the container guide which includes a bottom slide portion 90 and cup separation portions 92. Each bar 62 is angled forwardly so that it makes contact with both the lip of the lid of container 26 and the sidewall of container 26 to apply a driving force to the container without introducing a rotational torque which would tend to tip or distort the container.

Prior to bar 62 being driven into contact with the side of container 26 to remove it from the infeed conveyor, the container is restrained in the proper position on the conveyor by a fixed lateral support member 94 and a movable lateral support member 96. Movable lateral support member 96 is held in the upright position depicted in FIG. 5 by a flight bar 98 carried by a chain 99 which is driven by sprockets 101, 102, 103, and 104. Sprockets 101–104 are each mounted on shafts which are mounted for rotational movement relative to side plate 14, utilizing bearings 106–109 respectively. The shaft 110 upon which sprocket 103 is mounted projects through plate 14, and a sprocket 111 is mounted on the projecting portion. Sprocket 111 is driven by a chain 113 which is in turn driven by sprocket 112.

The coordination of the operation of chains 64 and 99 to remove containers from the infeed conveyor and move them along the container guides through the machine is as follows. As a group or row of six containers 26 is assembled by the infeed conveyor and belts 35 and 36, the clutch 292 is not actuated, and chains 64 and 99 remain stationary in the relative positions shown in FIG. 5. After the receipt of six cups has been detected by sense switch 59', mounted on side plate 15 in the vicinity of the infeed conveyor and by the counting circuit 132 of counter 300, clutch 292 is actuated to drive chains 64 one-half of a complete cycle so that bars 62 and 62' "exchange" positions. During that same period of time, sprocket 103 is driven in a clockwise direction, moving drive bar 98 upward to allow movable lateral support 96 to drop to a horizontal position in line with bottom guide 90 in synchronism with the movement of bars 62 against the containers 26 to move them to the right as viewed in FIG. 5. The next drive bar 115 carried by chain 99 then moves the cups by the end of the next cycle to the position in FIG. 5 where the sectional view of FIG. 6 is taken. Chain 99 carries additional flight bars 117 and 118 which are spaced to accomplish the four loading cycles per complete chain revolution to assemble four groups of six cups each.

As the rows of containers 26 are driven through the machine first by bars 62 and then by one of flight bars 98, 115, 117, or 118, they are separated from contact with containers in adjacent columns by dividers 92 and supported by slide members 90. In the preferred embodiment shown, each row of six containers assembled on the infeed conveyor is separated into two groups of three containers by a wider divider section 93 to facilitate the grouping of containers into two groups of four rows and three columns for loading two twelve-container cases simultaneously.

As the rows of containers are moved across the container guides and through the machine, tipping is prevented by longitudinal hold-down bars 120, shown in FIGS. 5 and 6. In order to permit flight bars 98, 115, 117, and 118 to pass through slide member 90, a portion 122 of guide 90 is arranged for downward pivotal movement to the position shown in ghost outline in FIG. 5. The movement of portion 122 in coordination with chain 99 is accomplished, as shown in FIGS. 1 and 2*a*, by attaching portion 122 to a pivotally mounted arm 132 which is driven by a chain 126 connected to a sprocket 127 of reducer 84. Chain 126 drives a cam 128 which is mounted on a bearing assembly which is installed on side plate 14. Cam 128 moves arm 132 in a counterclockwise movement about its pivot point 133 to momentarily depress portion 122 below the horizontal to permit passage of one of the flight bars 98, 115, 117, or 118 through guide 90. The spring force to urge arm 132 against cam 128 is provided by a spring 134.

As the rows of six containers 26 are moved from the infeed conveyor through the machine as shown in FIG. 5, they are assembled at the righthand end of the machine is an assembly area. Positioning of containers 26 in the assembly area is controlled by pins 135 attached to a pivoted arm 136 which is connected through links 137 and 138 to a shaft 133 driven by cam actuated arm 132.

After four rows of six cups each are assembled in the assembly area, the cup clamp head assembly 140 is moved over the cups in the assembly position, lowered into place, and actuated to grip each of the individual containers 26. Cup clamp assembly 140 is then moved in the same plane to the right, as viewed in FIG. 1, to a delivery position where, in the preferred embodiment, a pair of opened empty cases is raised from a case conveyor belt 142 to receive the containers.

The construction of cup clamp head assembly 140 is shown in more detail in FIGS. 11 and 12 which are perspective views of the entire head in opened and closed positions respectively and FIGS. 8–10 which are detailed elevation and cross-sectional views of one half of the actuating mechanism of the assembly. As generally shown in FIGS. 1 and 2*a*, cup clamp assembly 140 is carried by a frame 144 which is mounted for slidable movement along horizontal supports 22 and 24. Cup clamp head assembly 140 is moved from a cup receiving position to a cup unloading position shown in FIGS. 1 and 2*a* by actuating the head assembly solenoid of pneumatic actuator 145 which is attached at one end to frame 10 and at the other end to a link 146 which is in turn attached to rotate a shaft 147 which is secured to frame 10 by a suitable bearing 148. An arm 150 is attached to the projection of shaft 147 and is pivotally connected to one end of a link 152, the other end of which is pivotally connected to frame 144. When actuator 145 is extended by the circuitry shown in the schematic diagram of FIG. 13, arm 150 is rotated in a clockwise direction by shaft 147 to move cup clamp head assembly 140 to the right to the cup unloading position above conveyor belts 142.

The operation of cup clamp head assembly 140 to receive and to unload containers 26 is controlled by cup clamp solenoids 155 and 155′ which are actuated by the circuitry shown in schematic diagram FIG. 13. The clamping portions of cup clamp head assembly 140 are raised when the assembly 140 is moved from the position shown in FIGS. 1 and 2*a* to a position above the cup collecting area. The vertical movement of the clamping portions of cup clamp head assembly 140 is controlled by solenoid 158 which is controlled by the circuitry shown in the schematic diagram of FIG. 13. In the preferred embodiment, the cup clamps are lifted slightly over one-half inch when cup clamp assembly is moved from the righthand position shown in FIG. 1 to a cup receiving position over the cup assembly area. When cup clamp head assembly 140 is moved from the cup receiving position to the position shown in FIG. 1, the entire movement takes place with the cup clamps in the lowered position to minimize the loading time and avoid unnecessary vertical movement of the cups to disturb their contents. When the machine is used to load containers filled with separate portions of hot yogurt and jelly, it is critical that jostling of the containers be avoided to avoid the undesired blending together of the hot yogurt and jelly. The raising and lowering of the cup clamp heads relative to the frame of cup clamp head assembly 140 by actuator 158 is facilitated by means of guides 160–163 which ensure that the clamp heads remain level and which include springs to cushion the movement of the clamp head as it is raised and lowered.

Each of containers 26 is gripped at four points by lugs 166 as shown in FIG. 12. The lugs are projections from clamps 170–175, shown in FIGS. 9 and 10. Clamps 170, 172, and 174 are attached to clamp holders 176 and 177, while clamps 171, 173, and 175 are attached to clamp holders 179 and 180. Clamp holders 176 and 177 are slidably movable along clamp shafts 182 and 183 respectively in a downward direction as viewed in FIG. 8, while clamp holders 179 and 180 are slidably movable along clamp shafts 182 and 183 in an upward direction as viewed in FIG. 8. Drive shafts 179 and 180 are joined by a shaft 184, while clamp holders 177 and 176 are joined by a clamp pivot breakout 185 which includes a shaft portions 186. Links 188 and 189 are mounted for movement about shaft 184 and a further shaft 190. Links 191 and 192 are also mounted for rotational movement about shaft 190 and shaft 186. Shaft 190 is in turn mounted in pivot block 193. Pivot block 193 is connected to one end of a shaft 195 which is connected at its other end to the piston of actuator 155.

When actuator 155 is actuated to retract the piston to the position shown in ghost outline in FIG. 10, opposed pairs of cup clamps 170–171, 172–173, and 174–175 are drawn together as vertical movement of shaft 190 is coupled by links 188, 189, 191, and 192 into horizontal movement of shafts 184 and 186 toward one another, causing movement of clamp holders 177 and 176 downwardly, as viewed in FIG. 8, and movement of clamp holders 180 and 189 upwardly as shown in FIG. 8. Each of containers 26 is grasped at four points by the downwardly projecting lugs 166. As shown in FIG. 12, each of the downwardly projecting lugs are angled so as to contact the sidewall of container 26 with the most extreme projection of lug 166 and to contact the bottom lip portion of container 26 with the angular edge of lug 166.

Figure 7:
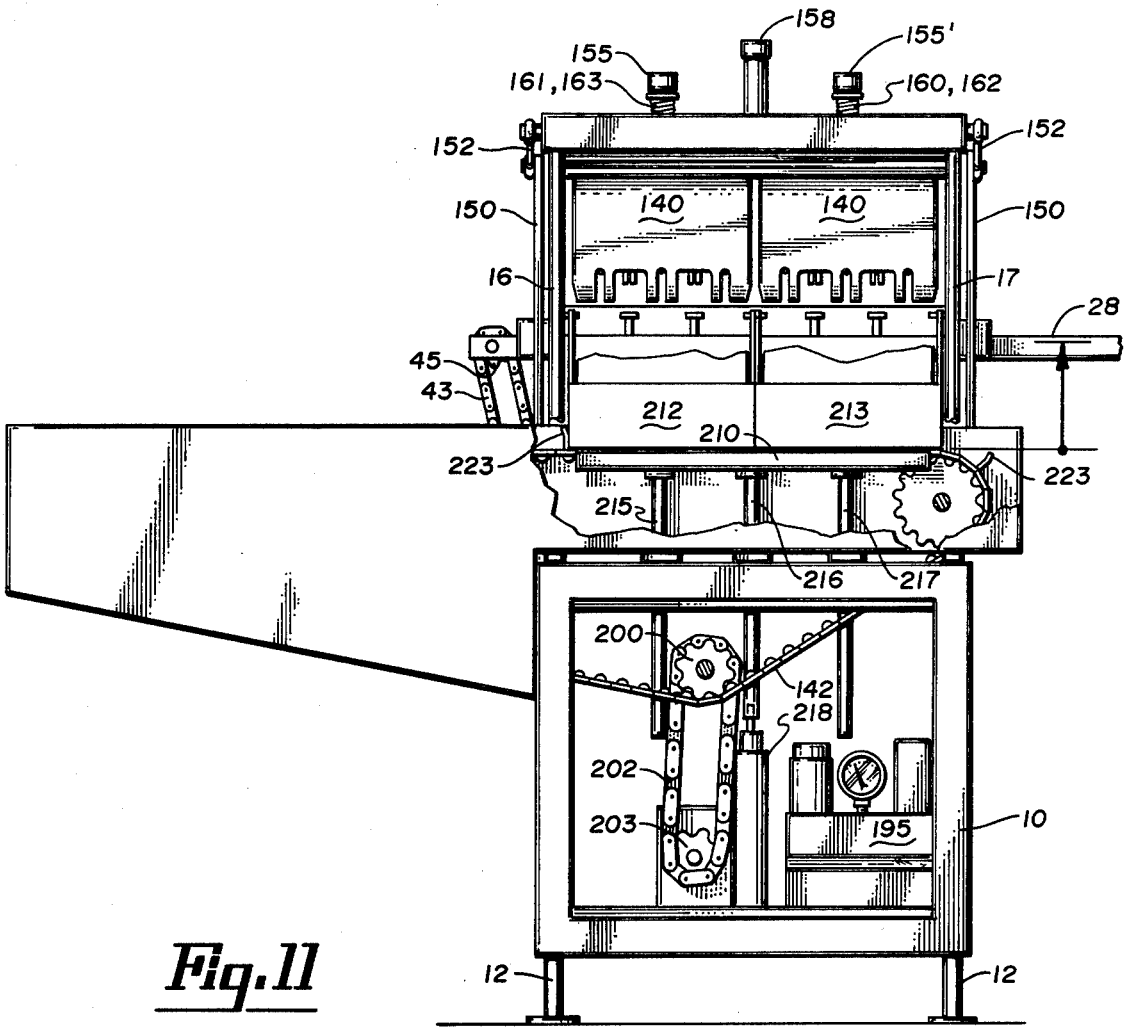
FIG. 7 is an end taken on lines 7—7 view of the machine 6—6 of FIG. 2.

After cup clamp head assembly 140 engages each of containers 26, it is moved to the cup delivery position shown in FIGS. 1 and 2*a* above conveyor belts 142 by actuating the solenoid of actuator 145. After cup clamp head assembly 140 is positioned above conveyor belts 142, two cases are moved into place, as shown in FIG. 7, by belts 142 which are driven by a sprocket 200, a chain 202, and a further sprocket 203 which is attached to a shaft of a clutch 204 driven by motor 205. The erected and opened cases are loaded on conveyor belts 142 by means not shown, such as a conventional case erecting machine, or by hand.

Actuation for motor 205 and its clutch 204 is controlled by the circuitry shown in detail in FIG. 13. The cases are positioned below cup clamp head assembly 140 and then moved upwardly by the action of an elevator 210 which can be moved from an initial position between conveyor belts 142 and parallel to the top surface of the belt to an extended position wherein cases 212 and 213 are raised vertically under cup clamp head assembly 140 into a container receiving position nearly touching the bottoms of containers 26 carried by assembly 140. Case elevator 210 is moved by vertical supports 215, 216, and 217 which are moved upwardly by the action of actuator 218. After assembly 140 releases the containers, case elevator 210 is moved back to its initial position, and conveyor belts 142 are driven to remove the case from the machine and position two new unfilled cases in position beneath mechanism 140. The coordination of the positioning of cases 212 and 213 relative to the surface of conveyor belts 142 is accomplished utilizing projecting lugs 223 to assure proper positioning of cases 212 and 213 relative to clamp assembly 140 and case elevator 210. Vertical movement of the cases to receive cups 26 from clamp head 140 minimizes disturbance to the contents of containers 26 and also avoids damage to cups 26 by the lugs 166 of clamp head 140.

FIG. 13 is a schematic diagram of the electrical and pneumatic circuitry which controls the operation of the carton filling machine. Three phase ac power is applied to the machine through lines 228, 229, and 230 which are shown with a fused disconnect circuit 232 and a series door disconnect switch 233 which serves to remove power from the system when the door, not shown in the drawings, at the side of the control box containing the electrical connectors is opened. The ac power is fused inside of the control box using fuses 234, 235, and 236. The ac power is applied to three motors, the cup infeed and conveyor motor 240, cup conveyor motor 85, and box infeed conveyor motor 205. Each motor is driven by all three phases, and each includes suitable overload protection 245. Each motor also includes a set of contacts 250, 251, and 252 on each of the three input lines. Contact sets 250, 251, and 252 are in turn controlled by solenoid windings 255, 256, and 257. A motor run indicator 258 is connected to the parallel connection of those windings to visually indicate the application and power to the motor run solenoids. The motor starting circuit is comprised of a start switch 260 which provides the momentary switch closure necessary to begin the starting sequence until power has been applied to windings 255, 256, and 257 to close contact sets 250, 251, and 252 in series with the motor lines and to close holding contacts 250', 251', and 252' which are also closed upon actuation of windings 255, 256, and 257. The starting circuit path also passes through motor stop switch 261 which is normally closed and provides an operator-controlled interrupt of current to disable the three motor solenoids 255, 256, and 257 to remove ac power from the motors. The motor starting circuit also includes series breaker contacts 265, 266, and 267 which are actuated by the sensing of an overload in any of the motor lines by overload circuit detector 245. The motor starting circuit and other controls are actuated by stepped-down ac voltage received from transformer 270 and is fused with a series fuse 271.

After power is applied to the system by closing switch 260, power is applied to the motor controls by switch 270' which actuates solenoid windings 271 to close contacts 273 which are in parallel with switch 270 to keep the control power on until some interruption occurs on the motor start circuit line discussed previously. The presence of control power is indicated to the operator by a yellow indicator light 275.

The control timing for the machine is provided by a Gemco brand cam operated unit 280 which is driven by a chain 281 from the output shaft of reducer 84. The timer 280 closes its contact sets at particular angular rotational positions in accordance with the timing chart shown in FIG. 13*a*. The particular contacts which are operated by the timer control the box conveyor clutch solenoid (285), the reset complete, indicator (286), the box platform solenoid (287), the clamp head assembly (288), the cup clamp (289), and the clamp head (290).

The circuits for contacts 285–290 of FIG. 14 are all shown in FIG. 13. Box platform actuator solenoid 218 is in series with contacts 287. In series with contacts 288 is the head assembly out and back actuator solenoid 145. In series with contacts 289 is the cup clamp open and close actuator solenoid 155, and in series with contacts 290 is the clamp head up and down actuator solenoid 158. All of the actuators are connected to pneumatic supply 195'.

In series with contacts 285 is the solenoid for the box infeed clutch 291. In series with the cups in-flight clutch solenoid 292 is a set of contact 295 controlled by the cup counter, the wiring of which is shown in detailed schematic form in FIG. 13*a*. The terminal designations shown in FIG. 13*a* are those specified by the manufacturer of the timer to form a count to six counter to count the passage of six cups along the infeed conveyor to the machine. After six cups have been counted and the contacts 295 close, the solenoid of clutch 292 is actuated causing one cycle of operation of the infeed sequence to move a row of six cups from the infeed conveyor to an assembly position in the machine. If the operator desires for any reason to cycle the operation of the machine prior to receiving a full six cups from the infeed conveyor, he may do so by actuating a reset switch to close contacts 296 and open contacts 297. The closing of contacts 296 performs the same electrical function as the closing of the counter contacts 295. The opening of reset contacts 297 disconnects the counter circuit 300 shown in FIG. 13*a* to prevent an inadvertent double actuation of the in-flight clutch solenoid 292 by actuation of the reset contacts followed by an immediate actuation of the counter contacts. After the reset has been operated to advance the timer 280 to the 0° position, the reset complete indicator 286' is actuated.

After the receipt of 24 cups in four rows of six by four consequent actuations of in-flight clutch 292, box platform actuator solenoid 218 is actuated to raise the box platform, the head assembly out and back actuator solenoid 145 is actuated to move the head assembly over the assembled cups, and box platform actuator solenoid 218 is actuated to lower the head assembly, and cup clamp solenoid 155 is actuated to close the clamp mechanism around the cups. The head assembly is then moved by action of solenoid 145 back over the box conveyor in platform, the box platform solenoid is actuated to bring the platform and boxes into contact with the bottom surface of the cups held in the cup clamp, and the cup clamp solenoid 155 is is then lowered to permit the box conveyor belts 142 to drive the loaded cases from the machine.

What is claimed is:

1. A case filling machine for receiving a multiplicity of tapered wall containers from a conveyor and loading them into opened cases, said machine comprising, in combination:

(a) a continuously driven serial conveyor for receiving containers and transporting a row of said containers to a first intermediate position within said machine, said serial conveyor comprising a continuously driven belt conveyor terminating in a low friction drive portion to reduce frictional drive forces imparted to the bottoms of said containers after they reach said first intermediate position, and wherein said low friction drive portion of said serial conveyor is comprised of flexible belt means which passes over a plurality of spaced support means, each of which forces the belt conveyor into contact with the bottoms of said containers only in the vicinity of said support means;

(b) guide means defining a plurality of container moving paths transverse to the path of said serial conveyor;

(c) drive means for propelling a row of said containers from said first intermediate position on said serial conveyor and through said guide means to a second intermediate position;

(d) a first frame movable transversely of said serial conveyor from a first position above said second intermediate position to a further position;

(e) a case conveyor for transporting empty cases into position at a lower level than that of said second intermediate position and for transporting cases loaded with containers from said machine;

(f) container clamping means mounted on said frame, said container clamping means constructed and arranged to releasably grip containers assembled at said second intermediate position and support them until said frame is moved to said further position; and (g) means for vertically moving empty cases from said case conveyor into container receiving position below said further position of said frame with the bottom of said cases in close proximity with the bottom surface of said containers to receive said containers when said container clamping means is released, and for returning the case and containers to said case conveyor.

2. The invention claimed in claim 1 wherein said low friction drive portion of said serial conveyor is comprised of a flexible belt which passes over a plurality of support pins, each of which forces the belt into contact with the bottoms of said containers only in the vicinity of said pins.

3. A case filling machine for receiving a multiplicity of tapered wall containers from a conveyor and loading them into opened cases, said machine comprising, in combination:

(a) a continuously driven serial conveyor for receiving containers and transporting a row of said containers to a first intermediate position within said machine, said serial conveyor comprising a continuously driven belt conveyor terminating in a low friction drive portion to reduce frictional drive forces imparted to the bottoms of said containers after they reach said first intermediate position and said low friction drive portion of said serial conveyor is comprised of a flexible O-ring belt which passes over a plurality of pins, each of which forces the belt into contact with the bottoms of said containers only in the vicinity of said pins;

(b) guide means defining a plurality of container moving paths transverse to the path of said serial conveyor;

(c) drive means for propelling a row of said containers from said first intermediate position on said serial belt conveyor and through said guide means to a second intermediate position;

(d) a first frame movable transversely of said serial conveyor from a first position above said second intermediate position to a further position;

(e) a case conveyor for transporting empty cases into position below the level of said second intermediate position and for transporting cases loaded with containers from said machine;

(f) container clamping means mounted on said frame, said container clamping means constructed and arranged to releasably grip containers assembled at said second intermediate position and support them until said frame is moved to said further position; and (g) means for vertically moving empty cases from said case conveyor into container receiving position below said further position of said frame with the bottom of said cases in close proximity with the bottom surface of said containers to receive said containers when said container clamping means is released, and for returning the case and containers to said case conveyor.

4. A case filling machine for receiving a multiplicity of tapered wall containers from a conveyor and loading them into opened cases, said machine comprising, in combination:

(a) guide means defining a plurality of container moving paths;

(b) drive means for propelling a row of said containers through said guide means;

(c) a continuously driven serial conveyor for receiving containers and transporting a row of said containers to a first intermediate position within said machine, the path of said serial conveyor positioned transverse to the guide means and including low friction gate means positioned parallel to the path of said serial conveyor and in contact with both sides of containers carried by said serial conveyor to restrain lateral movement of said containers; and also including actuator means coordinated with said drive means for retracting at least a portion of said low friction gate means from contact with said containers to permit them to be moved by said drive means from a first intermediate position on said serial conveyor through said guide means to a second intermediate position;

(d) a first frame movable transversely of said serial conveyor from a first position above said second intermediate position to a further position;

(e) a case conveyor for transporting empty cases into position at a lower level than that of said second intermediate position and for transporting cases loaded with containers from said machine;

(f) container clamping means mounted on said frame, said container clamping means constructed and arranged to releasably grip containers assembled at said second intermediate position and support them until said frame is moved to said further position; and (g) means for vertically moving empty cases from said case conveyor into container receiving position below said further position of said frame with the bottom of said cases in close proximity with the bottom surface of said containers to receive said containers when said container clamping means is released, and for returning the case and containers to said case conveyor.

5. A case filling machine for receiving a multiplicity of tapered wall containers from a conveyor and loading them into opened cases, said machine comprising, in combination:

a continuously driven serial conveyor for receiving containers and transporting a row of said containers to a first intermediate position within said machine;

(b) guide means defining a plurality of container moving paths transverse to the path of said serial conveyor, said guide means including a plurality of support rails positioned below each of said containers and also including a plurality of restraining rods positioned parallel to and above said support rails in contact with the tops of said containers to prevent tipping of said containers as they are moved along said support rails;

(c) drive means for propelling a row of said containers from said first intermediate position on said serial conveyor and through said guide means to a second intermediate position;

(d) a first frame movable transversely of said serial conveyor from a first position above said second intermediate position to a futher position;

(e) a case conveyor for transporting empty cases into position at a lower level than that of said second intermediate position and for transporting cases loaded with containers from said machine;

(f) container clamping means mounted on said frame, said container clamping means constructed and arranged to releasably grip containers assembled at said second intermediate position and support them until said frame is moved to said further position; and (g) means for vertically moving empty cases from said case conveyor into container receiving position below said further position of said frame with the bottom of said cases in close proximity with the bottom surface of said containers to receive said containers when said container clamping means is released, and for returning the case and containers to said case conveyor.

6. A case filling machine for receiving a multiplicity of tapered wall containers from a conveyor and loading them into opened cases, said machine comprising, in combination:

(a) a continuously driven serial conveyor for receiving containers and transporting a row of said containers to a first intermediate position within said machine;

(b) guide means defining a plurality of container moving paths transverse to the path of said serial conveyor, said guide means including a plurality of support rails positioned below each of said containers and also including a plurality of restraining rods positioned parallel to and above said support rails in contact with the tops of said containers to prevent tipping of said containers as they are moved along said support rails;

(c) drive means for propelling a row of said containers from said first intermediate position on said serial conveyor and through aid guide means to a second intermediate position, said drive means comprising;

(1) a first propelling means for moving said row of containers from said first intermediate position on said serial conveyor into said guide means, and (2) a second propelling means for moving said row of containers along said guide means to said second intermediate position, (d) a first frame movable transversely of said serial conveyor from a first position above said second intermediate position to a further position;

(e) a case conveyor for transporting empty cases into position at a lower level than that of said second intermediate position and for transporting cases loaded with containers from said machine;

(f) container clamping means mounted on said frame, said container clamping means constructed and arranged to releasably grip containers assembled at said second intermediate position and support them until said frame is moved to said further position; and (g) means for vertically moving empty cases from said case conveyor into container receiving position below said further position of said frame with the bottom of said cases in close proximity with the bottom surface of said containers to receive said containers when said container clamping means is released, and for returning the case and containers to said case conveyor.

7. The invention claimed in claim 6 wherein said first propelling means is comprised of a series of pusher bars constructed and arranged to contact the top lip and side wall of said containers simultaneously and to apply force thereto parallel to the plane of said guide means to minimize tipping forces applied to said containers.

8. The invention claimed in claim 6 wherein said second propelling means comprises a series of flight bars carried by chains to move said containers along said support rails and wherein said support rails of said guide means are articulated to permit and flight bars to pass through the plane of said guide means after said row of containers has been moved to said second intermediate position.

9. A case filling machine for receiving a multiplicity of tapered wall containers from a conveyor and loading them into opened cases, said machine comprising, in combination:

(a) a continuously driven serial conveyor for receiving containers and transporting a row of said containers to a first intermediate position within said machine;

(b) guide means defining a plurality of container moving paths transverse to the path of said serial conveyor, said guide means including a plurality of support rails positioned below each of said containers and also including a plurality of restraining rods positioned parallel to and above said support rails in contact with the tops of said containers to prevent tipping of said containers as they are moved along said support rails, said guide means also including a plurality of rows of retractable stop means positioned at a second intermediate position along said paths of said guide means to define stopping positions for containers moved from said serial conveyor along said guide means so that a plurality of rows of containers can be assembled in a non-touching array in said second intermediate position;

(c) drive means for propelling a row of said containers from said first intermediate position on said serial conveyor and through said guide means to said second intermediate position;

(d) a first frame movable transversely of said serial conveyor from a first position above said second intermediate position to a futher position;

(e) a case conveyor for transporting empty cases into position at a lower level than that of said second intermediate position and for transporting cases loaded with containers from said machine;

(f) container clamping means mounted on said frame, said container clamping means constructed and arranged to releasably grip containers assembled at said second intermediate position and support them until said frame is moved to said further position; and (g) means for vertically moving empty cases from said case conveyor into container receiving position below said further position of said frame with the bottom of said cases in close proximity with the bottom surface of said containers to receive said containers when said container clamping means is released, and for returning the case and containers to said case conveyor.

* * * * *

UNITED STATES PATENT AND TRADEMARK OFFICE

CERTIFICATE OF CORRECTION

PATENT NO. : 4,199,918

DATED : April 29, 1980

INVENTOR(S) : Bertel R. Peterson

It is certified that error appears in the above-identified patent and that said Letters Patent are hereby corrected as shown below:

Column 1, line 63, delete "taken on lines 7-7".

Column 1, line 64, delete "6-6", and insert therefor --taken on lines 7-7--.

Column 2, line 9, delete "operatings", and insert therefor --operating--.

Column 5, line 6, delete "is", and insert --in--.

Column 6, line 19, delete "portions", and insert therefor --portion--.

Column 10, line 65, before "a", insert --(a)--.

Column 11, line 54, delete "aid", and insert --said--.

Column 12, line 27, delete "and", and insert --said--.

Signed and Sealed this

*First* Day of *July 1980*

[SEAL]

*Attest:*

SIDNEY A. DIAMOND

*Attesting Officer*

*Commissioner of Patents and Trademarks*